United States Patent [19]

Lucke

[11] 4,089,479

[45] May 16, 1978

[54] PACKAGE WINDING MACHINE

[75] Inventor: Florian Lucke, Mengen, Germany

[73] Assignee: Croon & Lucke Maschinenfabrik GmbH & Co. KG, Germany

[21] Appl. No.: 679,992

[22] Filed: Apr. 26, 1976

[30] Foreign Application Priority Data

May 2, 1975 Germany ..... 2519630

[51] Int. Cl.[2] ..... B65H 54/10; B65H 54/64

[52] U.S. Cl. ..... 242/2; 242/35.5 R

[58] Field of Search ..... 242/2, 7.14, 25 A, 35.5, 242/53; 140/92.1

[56] References Cited

U.S. PATENT DOCUMENTS

| | | | |
|---|---|---|---|
| 1,250,436 | 12/1917 | Curry | 242/2 |
| 3,101,180 | 8/1963 | Sadolf | 242/7.14 |
| 3,510,939 | 5/1970 | Smith | 140/92.1 X |
| 3,525,147 | 8/1970 | Kieffer | 140/92.1 X |
| 3,811,630 | 5/1974 | Muskulus et al. | 242/7.14 |

*Primary Examiner*—Billy S. Taylor

*Attorney, Agent, or Firm*—Allen D. Gutchess, Jr.

[57] ABSTRACT

A machine for simultaneously winding a plurality of yarn packages. Yarn is wound on each of a series of spindles by an associated rotated guide structure. Each guide structure includes a crank-shaped arm or guide portion adjacent to a spindle for directing yarn to the spindle, and a drive arm or section supported for rotation. The drive arms of the guide structures are simultaneously driven by a common drive motor and belt acting on individual pulleys connected to each drive arm via a sleeve and counterbalanced fork piece. The guide structures are selectively simultaneously adjustable in an axial direction by a crank operated screw shaft and nut mechanism.

4 Claims, 4 Drawing Figures

PACKAGE WINDING MACHINE

This invention relates to a package winding machine, in particular of the type having at least two rotatable winding spindles and travellers or flyers respectively associated with each winding spindle, which travellers are rotatably drivable as well as axially displaceably mounted and which supply each winding spindle with a yarn to be wound to form a package.

In the known package winding machines of this type it is necessary for the travellers to be axially displaceable, because in this manner the shape, the size and in particular the central opening of the package can be influenced. Previously each traveller had to be adjusted separately, which is a cumbersome and time consuming operation in the usual machines with 16 or 20 winding points, quite apart from the fact that it is difficult to obtain uniform adjustment of all the travellers in a manner which ensures the production of similar packages at each winding point.

It is an object of the present invention to provide a package winding machine in which all travellers are commonly and accurately adjusted by a simple operation so that each traveller produces a package of the same configuration on the winding spindle associated therewith.

The present invention provides a package winding machine comprising at least two rotatable winding spindles and travellers respectively associated with each winding spindle, which travellers are rotatably drivable as well as axially displaceably mounted and which supply each winding spindle with a yarn to be wound to form a package, wherein each traveller is axially displaceably mounted in a driven hollow shaft connected to the traveller for rotation therewith, and drive members respectively engaging the travellers by way of respective rotary bearings for axially displacing the travellers in unison by means of a common transverse drive directed parallel to the axes of the travellers.

The invention will be further described by way of example only, with reference to the accompanying drawings, in which.

Figure 1:
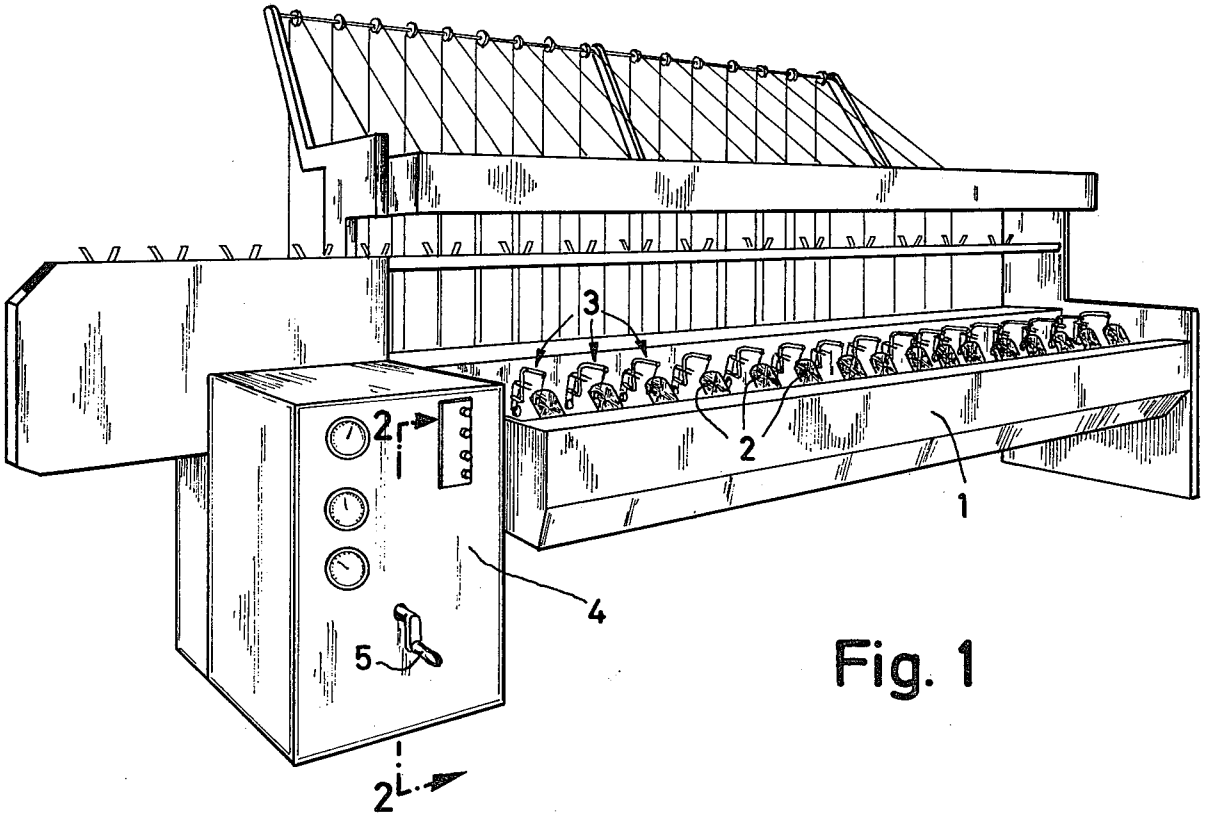
FIG. 1 is a front perspective view of a package winding machine according to the invention.
Figure 3:
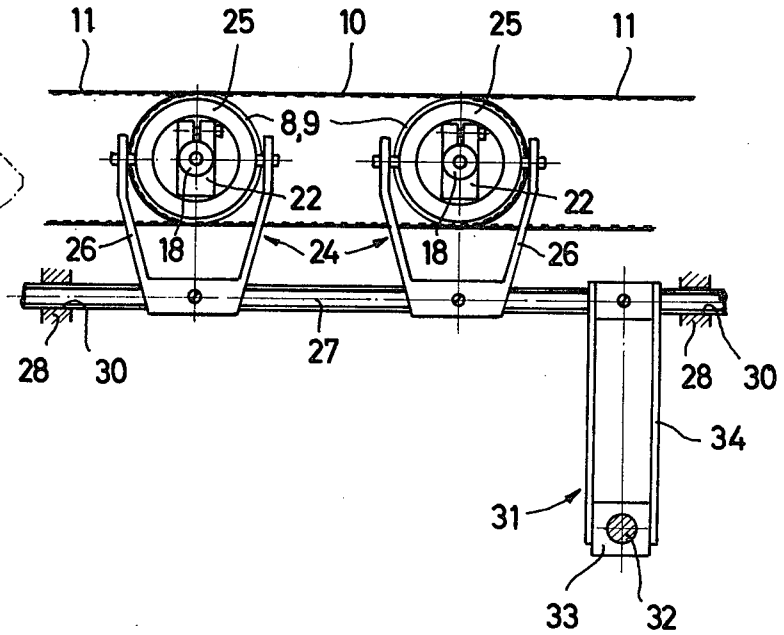
FIG. 3 is a cross-section taken along the line 3—3 in FIG. 2.
Figure 2:
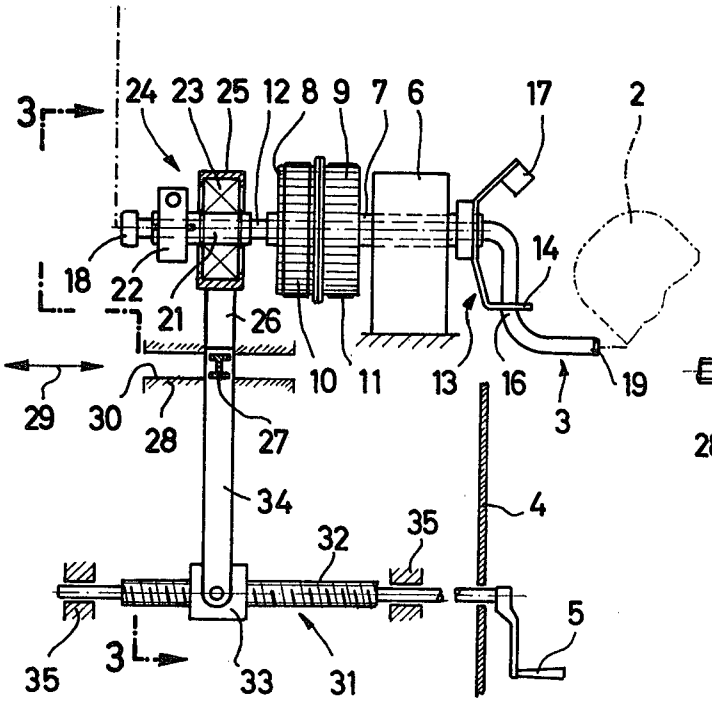
FIG. 2 is a cross-section taken along the line 2—2 in FIG. 1.

The package winding machine shown in the drawings comprises a machine frame 1 on which are mounted a plurality of winding spindles 2 and double-cranked travellers or flyers 3 respectively associated therewith. Drive motors with associated electrical control for the winding spindles 2 and the travellers 3 are accommodated in a housing 4 forming part of the machine frame. The driving force is supplied from the housing 4 to the spindles 2 and the travellers 3 by way of transmission devices (not shown in FIG. 1). The housing 4 is provided with a crank 5 by means of which all the travellers 3 can be commonly adjusted by the same path length parallel to their axis of rotation, as will be described in detail with reference to FIGS. 2 and 3.

A hollow shaft 7 is rotatably mounted in a stand bearing 6 associated with each traveller 3 and each hollow shaft 7 is rigidly connected to two belt pulleys 8 and 9. A belt 10 around the pulley 8 leads to a corresponding pulley of the adjacent traveller on the one side, and a belt 11 around the pulley 9 leads to the corresponding pulley of the adjacent traveller on the other side. In the case of the traveller located furthest on the left in FIG. 1, the one belt leads to the drive motor. In this manner all the hollow shafts 7 are driven in unison. The belt pulleys 8 and 9 and the belts 10 and 11 may be toothed wheels and toothed belts respectively.

Figure 4:
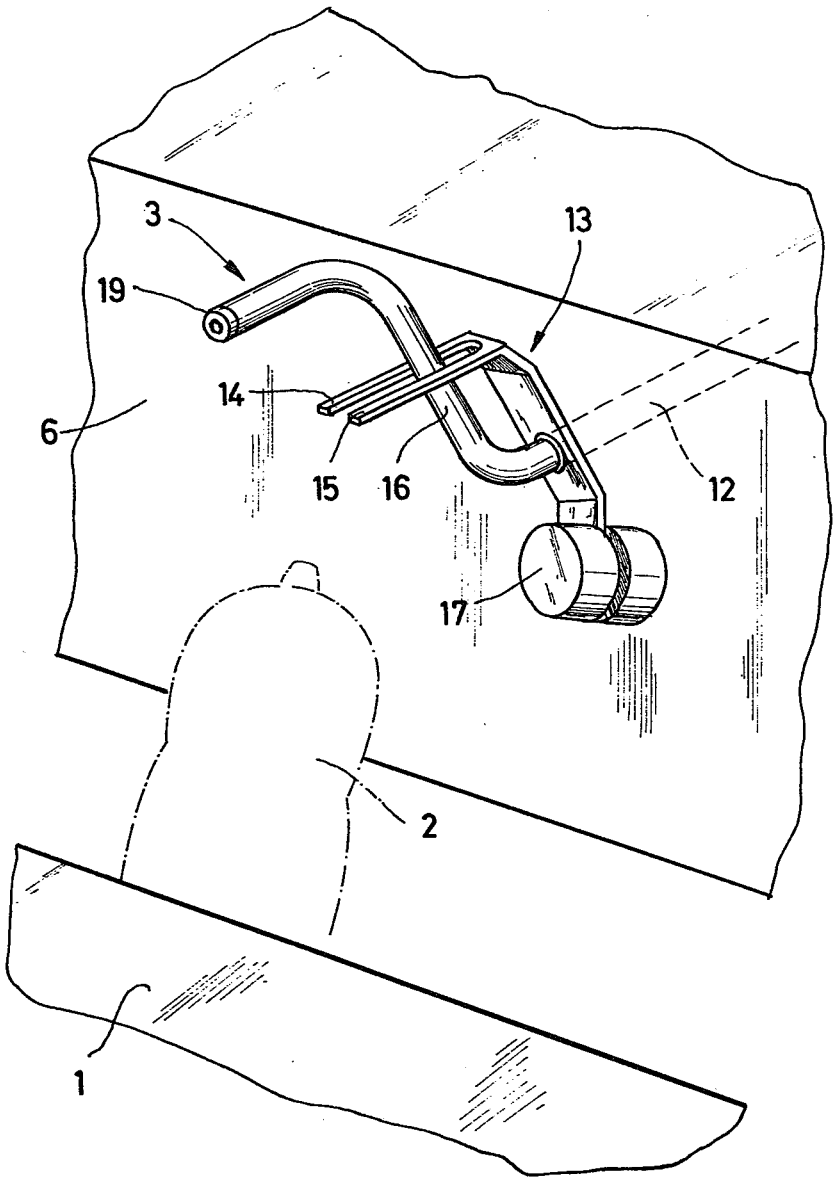
FIG. 4 is a detailed view of a part of the machine shown in FIG. 1, on an enlarged scale.

Each hollow shaft 7 encloses an arm 12 extending coaxial of the axis of rotation of the respective traveller 3 in such a manner that the traveller is displaceable parallel to the axis of rotation in the hollow shaft 7. In order to produce a rotary driving connection between the driven hollow shafts 7 and the travellers 3, each hollow shaft 7 supports at its end located on the right in FIG. 2 a fork 13 which is rigidly connected to the shaft and the limbs 14 and 15 of which embrace a cranked arm 16 of the traveller 3 in such a manner (see FIG. 4) that the traveller is rotationally displaced upon rotation of the hollow shaft 7. At the end of the fork 13 remote from the limbs 14 and 15 is a counterbalance 17.

Each traveller 3 is hollow, and the yarn to be fed to the winding spindle 2 is inserted through an opening 18 at the one end of the traveller and issues at the other cranked end 19.

A short slotted hollow bearing shaft 21 is pushed over the portion of the arm 12 freely projecting from the hollow shaft 7 and is rigidly clamped thereon by means of a clamping member 22. A drive member 24 is rotatably mounted on the hollow shaft 21 by means of a roller bearing 23. The drive member 24 embraces an annular outer bearing part 25 which is rigidly connected to a guide fork 26. The guide forks 26 of all the travellers 3 are rigidly connected to a rail 27 which is preferably constructed as a profiled rail and which is displaceable on slide bearings 28 in guide tracks 30 in the direction of the arrow 29 in FIG. 2.

Upon displacement of the rail 27 the travellers 3 are also displaced parallel to their axis of rotation by means of the drive members 24 which are rigidly connected to the rail and which are in turn rotatably mounted on the arms 12 of the travellers 3. In this manner a common adjustment of all the travellers is possible.

The rail 27 is connected to a transverse drive 31 for the purpose of common adjustment of all the travellers. The transverse drive 31 comprises a screw-threaded spindle 32 which is connected to the crank 5 and on which a nut 33 is mounted. An arm 34 projects rigidly from the nut 33 and is in turn rigidly connected to the rail 27. The screw-threaded spindle 32 is stationarily mounted in bearings 35 on the housing 4. Accordingly, upon rotation of the crank 5, the nut 33, which is non-rotatably retained by the arm 34, is displaced. The nut 33 displaces the rail 27 by means of the arm 34, and the rail in turn displaces the travellers 3 by means of the drive members 24.

Instead of being disposed on a side of the machine (at the housing 4), the crank 5 with the transverse drive could alternatively be arranged in the centre of the machine. Instead of only a single screw-threaded spindle 32 with nut 33, alternatively a plurality thereof, distributed over the width of the machine, could be provided which are then driven in unison by a crank 5 by way of transmission means.

I claim:

1. In a yarn package winding machine comprising a main machine frame, a plurality of winding spindles rotatably mounted on said frame, and a plurality of hollow travellers rotatably mounted on said frame, there being one of said travellers for each of said winding spindles, each of said travellers having a first crank arm and a second crank arm, said second crank arm extending coaxial of the axis of rotation of said traveller and said first crank arm extending transversely from said second crank arm, each of said travellers supplying the associated winding spindle with yarn to be wound thereon to form a package on the spindle, the travellers remaining axially stationary with respect to the winding spindles during formation of the packages, the improvement comprising a hollow shaft surrounding part of each of said second arms and having fork means to embrace the first crank arm of the traveller, thereby to rotate the traveller upon rotation of said hollow shaft, said second arm being axially displaceable in said hollow shaft and projecting from said hollow shaft at the end opposite the first crank arm, a drive member rotatably mounted on the projecting portion of the second arm, guide means connected to said drive member, stationary slide bearings displaceably supporting said guide means, and common transverse drive means for shifting said guide means on said slide bearings parallel to the axes of rotation of said travellers to adjust said travellers in unison relative to said spindles.

2. A package winding machine according to claim 1 wherein said drive members are rotatably mounted on said second arm by roller bearings which are connected to said guide means, and said guide means are supported by said slide bearings through a common slide rail affixed to said guide means.

3. A package winding machine according to claim 1 wherein said common transverse drive means comprises a screw-threaded spindle, a nut mounted on said spindle, and means nonrotatably connecting said nut to said guide means.

4. A package winding machine according to claim 3 characterized further by a crank for rotating said screw-threaded spindles.

* * * * *